United States Patent [19]

Peterson

[11] 4,183,593

[45] Jan. 15, 1980

[54] SEWING MACHINE CABINET VIBRATION DAMPENING USING RUBBER MAGNETS

[75] Inventor: Wesley R. Peterson, Bound Brook, N.J.

[73] Assignee: The Singer Company, New York, N.Y.

[21] Appl. No.: 2,046

[22] Filed: Jan. 8, 1979

[51] Int. Cl.[2] ..... A47B 81/00; F16B 47/00

[52] U.S. Cl. ..... 312/21; 312/26; 312/30; 108/92; 16/DIG. 14; 248/206 A

[58] Field of Search ..... 312/21, 22, 23, 26, 312/30; 108/92, 48, 143; 112/217.1; 16/DIG. 14, 137; 248/206 A; 52/DIG. 4

[56] References Cited

U.S. PATENT DOCUMENTS

| | | | |
|---|---|---|---|
| 266,591 | 10/1882 | Hain | 108/92 |
| 272,121 | 2/1883 | Cleves | 16/137 |
| 2,662,720 | 12/1953 | Patton | 108/48 |
| 3,016,563 | 1/1962 | DeJong | 16/DIG. 14 |
| 3,159,372 | 12/1964 | McIntosh | 248/206 A |
| 3,384,037 | 5/1968 | Blevins | 312/26 |
| 4,100,684 | 7/1978 | Berger | 248/206 A |
| 4,123,124 | 10/1978 | Peets | 312/21 |
| 4,132,295 | 1/1979 | Hochfelsen | 312/30 |

OTHER PUBLICATIONS

3 M Company Product MGO-1017.

*Primary Examiner*—Victor N. Sakran
*Attorney, Agent, or Firm*—Michael H. Wallach; Robert E. Smith; Edward L. Bell

[57] ABSTRACT

A vibration dampening member for a sewing machine cabinet having metallic hinges for supporting a work surface in a raised position. The hinges are fastened so that they contact a resilient compound exhibiting magnetic properties which attracts the hinges to prevent the transmission of vibration between adjoining surfaces.

2 Claims, 4 Drawing Figures

SEWING MACHINE CABINET VIBRATION DAMPENING USING RUBBER MAGNETS

BACKGROUND OF THE INVENTION

Field of the Invention: This invention relates to sewing machine cabinets in general and more particularly to cabinets which have hinged work surfaces which may be raised against a sewing machine bed to increase the area of the work surface.

Description of the Prior Art: A common problem associated with sewing machine cabinets which have convertible work surfaces is that they are susceptible to excessive vibration while the sewing machine is operating. Sewing machines are inherently prone to producing vibrations by virtue of the reciprocatory and rotary components contained therein. Despite the use of vibration damping members, such as rubber feet or the like, a sewing machine is still susceptable to transmitting vibrations to the table on which it is mounted. The vibration is a distraction to the sewing machine operator and may be a source of fatigue which may cause degradation in the quality of the sewing project.

The vibration problem is further exacerbated when the sewing cabinet contains hinged members which are in contact with the surface on which the sewing machine is supported. Since the separate members of the hinges are joined by a pin or the like, which must be reasonably loose to operate properly, the hinge members are prone to producing an annoying vibration when the surfaces to which they are attached vibrate.

SUMMARY OF THE INVENTION

One object of this invention is to provide a means for dampening the transmission of sewing machine vibration from a surface which supports a sewing machine to a metallic hinge used to fasten an extension of the work surface to the work surface.

Another object is to employ a commercially available material which may be easily applied to a wood surface to dampen the vibration of an adjoining metal hinge.

It is also an object of this invention to provide a vibration dampening member which may be incorporated into a sewing machine cabinet without the requirement for close and costly dimensioned tolerances of the dampening member or cabinet parts.

The above objects and other advantages are achieved by fastening a commercially available resilient material which exhibits magnetic properties to surfaces which may contact the metallic hinges when the surfaces are moved toward or away from the sewing machine. When the hinges contact the resilient material, they are magnetically attracted by the magnetic property exhibited by the material and are thereby held against the material, thereby precluding vibration of the hinges. Since the material is made of a resilient composition, vibration of the wood surface to which the material is attached will be absorbed by the material with a minimum of retransmission to the hinge. The resilient material is preferably fastened to the hinged surface with cement, thereby making it easy to install during construction of the cabinet.

BRIEF DESCRIPTION OF THE DRAWINGS

The above and other objects of this invention will be evident from an understanding of the preferred embodiment which is hereinafter set forth in sufficient detail to enable those skilled in the art to readily understand the function, operation, construction and advantages of it when read in conjunction with the accompanying drawings in which.

DESCRIPTION OF THE PREFERRED EMBODIMENT

Figure 1:
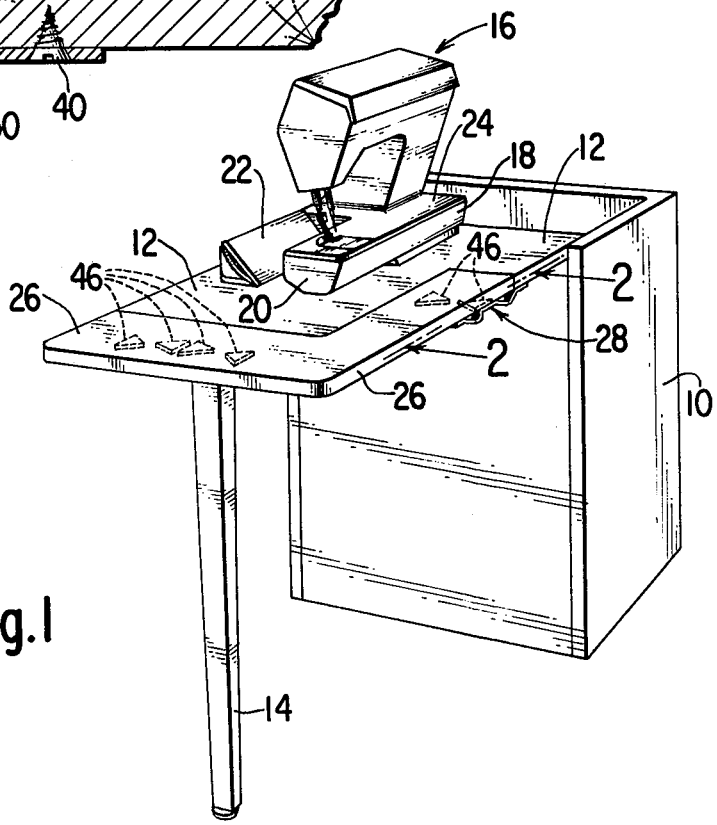
FIG. 1 is a perspective view of a sewing machine cabinet having a sewing machine fastened thereto and showing a convertible work surface in its lowered position.

Referring to the drawings, FIG. 1 shows a sewing machine cabinet having a base 10, a sewing machine support surface 12 fastened to the base 10, and a support leg 14 fastened to the support surface 12. The support surface 12 is constructed to support the weight of a sewing machine which is shown generally at 16. The sewing machine 16 has a base 18, with a convertible arm 20 fastened to the base 18. A convertible bed 22 is hingedly fastened to the base 18 and may be swung away from the convertible arm 20 to permit the sewing of tubular garments such as cuffs and legs. It will be appreciated by one skilled in the art of sewing that for most sewing projects which do not require the use of the convertible arm 20 with the convertible bed 22 in the lowered position, it is desirable to have a large surface area upon which to rest the fabric being sewn. It will thereby be seen that it is advantageous to have a means whereby the area of the work surface 24 of the bed 18 may be increased when needed, and removed when it is desired to use the sewing machine for stitching tubular projects. To that end a convertible work surface 26 is shown fastened to the support surface 12 with a pair of hinges 28. FIG. 1 shows that the convertible work surface 26 forms an extension of the support surface 12 and extends across the front and along a part of a side of the support surface 12. Preferably the convertible surface 26 is coplanar with the support surface 12 when in the lowered position so that work may be freely performed on the adjoining surfaces.

Figure 3:
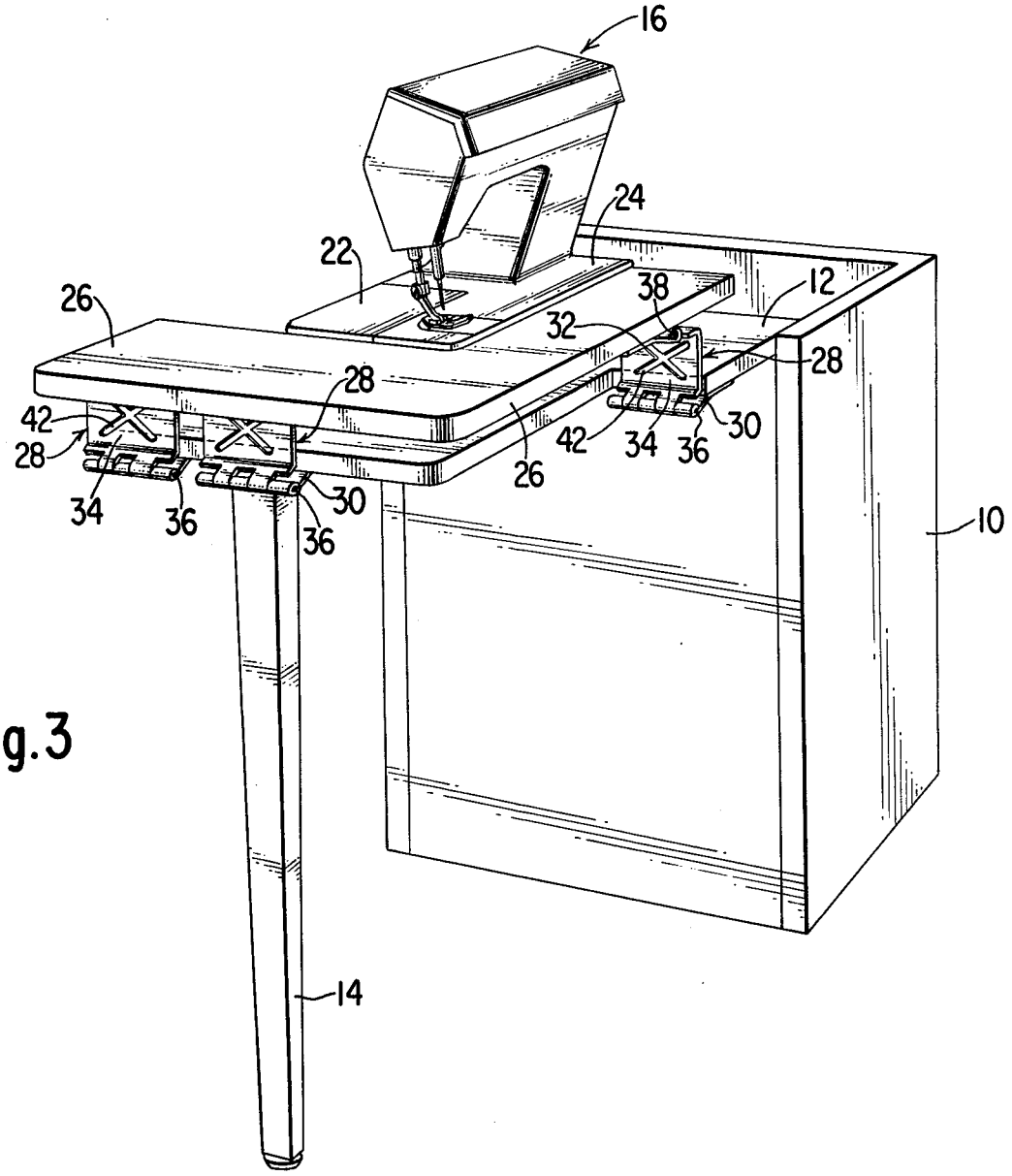
FIG. 3 is a view similar to FIG. 1 showing the convertible work surface in the raised position.

FIG. 3 shows that the convertible work surface 26 may be raised from its lowered position to a position where its top surface will be substantially flush with the work surface 24 of the sewing machine bed 18, with the hinges 28 supporting the work surface 26 in the raised position. It will be readily seen that when the convertible work surface 26 is in the raised position, a significant quantity of space is added to the work area about which a sewing machine operator may manipulate fabrics being sewn.

Figure 2:
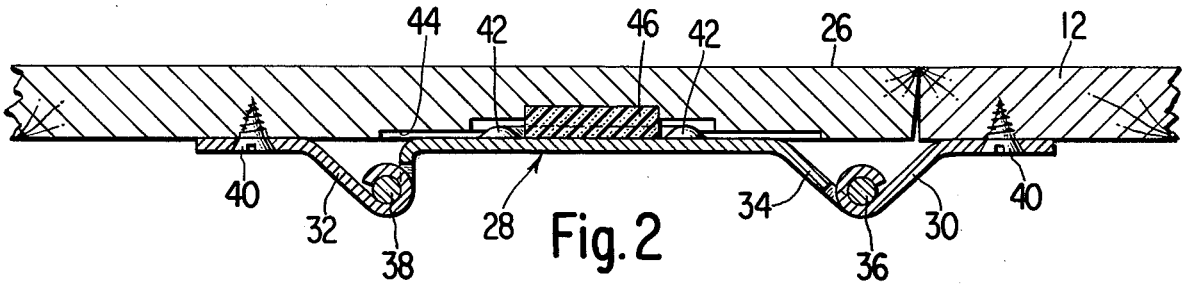
FIG. 2 is a side view taken along line 2—2 of FIG. 1 showing a hinge which may be used to fasten the convertible work surface to the sewing machine support surface and the position of the hinge when the convertible work surface is in the lowered position.
Figure 4:
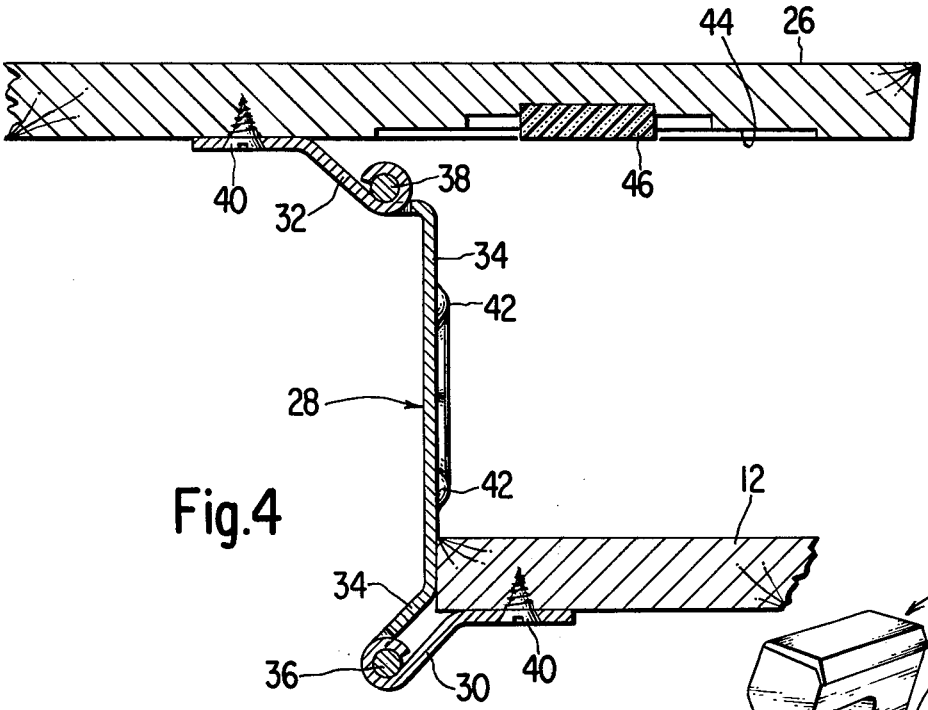
FIG. 4 is a view similar to FIG. 2 showing the position of the hinge when the convertible work surface is in the raised position.

FIGS. 2 and 4 best illustrate the construction of the hinges 28 which support the convertible work surface in its raised position. Referring more particularly to FIG. 4, one hinge 28 is shown to consist of a first hinge extension 30 and a second hinge extension 32, and a hinge body 34. A first hinge pin 36 pivotally fastens the first hinge extension 30 to the hinge body 34 and a second hinge pin 38 pivotally fastens the second hinge extension 32 to the hinge body 34. Preferably the first hinge extension 30 is fastened to the underside of the support surface 12 with screws 40 or similar fasteners and the second hinge extension 32 is fastened to the convertible work surface 26 with similar fasteners 40. Preferably the hinge body 34 has formed thereon a set of reinforcing struts 42 which act to provide torsional rigidity to the hinge body 34. FIG. 4 also shows that the underside of the convertible work surface 26 contains a rectangular aperture 44 in which the hinge body 34 may be recieved to prevent the body 34 from contacting the work surface 26 when the work surface 26 is in its lowered position. The hinges 28 are constructed from a ferrous material so that they may be attracted by a magnet placed in the vicinity thereof.

A material which may preferably be employed as a resilient vibration dampening member 46 to reduce the transmission of vibration between the convertible work surface 26 and the hinge body 34 is shown fastened within the aperture 44 on the convertible work surface 26. Preferably the vibration dampening member may be purchased commercially from the 3M Company as a composition of rubber and barium ferrite powder, which is sold under the trademark Plastiform brand self sticking permanent magnetic strip. As best shown in FIG. 1, the material is preferably cut into a shape to fit between the struts 42 of the hinge body 34.

The member 46 is fastened within the aperture 44 in the convertible work surface 26 by any suitable means, as for example with an adhesive cement. The member 46 is made to protrude below the bottom surface of the convertible work surface 26 so that it will contact the hinge body 34 before the body 34 contacts the bottom of the work surface 26, thereby preventing the transmission of vibration between the convertible work surface 26 and the hinge 28. It will be appreciated that the magnetic property of the member 46 will attract the ferrous hinge body 34 thereto, and will thereby overcome any tendency for the hinge body 34 to drop away from the work surface 26 due to the effects of either gravity or energy imparted to the hinge 28 as a result of vibration of the support surface 12. The magnetic attraction of the hinge body 34 to the member 46 will also permit the use of a member 46 whose dimensions need not be exact to effect the desired vibration dampening. Fig. 4 shows that when it is desired to move the convertible work surface 26 to its raised position, the hinge body 34 may be moved away from the vibration dampening member 46 with the hinge body 34 supporting the surface 26. A significant source of distracting vibration will therefore be reduced by the contact of the hinge body 34 against the vibration dampening member 46, thereby acting to reduce operator fatigue and distraction attributable to excessive vibration and noise.

Numerous alterations of the structure herein disclosed will suggest themselves to those skilled in the art in light of the above teachings. However, it is to be understood that the present disclosure relates to a preferred embodiment which is for the purpose of illustration only, and not to be construed as a limitation of the invention. All such modifications which do not depart from the spirit of the invention are intended to be included within the scope of the appended claims.

I claim:

1. In a sewing machine cabinet having a base, a sewing machine support surface fastened to the base for supporting a sewing machine thereon, said sewing machine having a bed supporting a work surface, a convertible work surface moveable from a lowered position wherein said convertible work surface forms an extension of said sewing machine support surface to a raised position wherein said convertible work surface forms an extension of the work surface of the sewing machine bed, and at least one articulated ferrous support hinge for supporting said convertible work surface in said lowered position and in said raised position, a vibration dampening member for dampening vibration associated with said at least one articulated support hinge for reducing the transmission of vibration between said support surface and said convertible work surface, said vibration dampening member comprising a material having a resilient surface which exhibits magnetic properties, whereby a ferrous hinge placed in the vicinity thereof will be attracted to said vibration dampening member and precluded from vibrating by said resilient surface.

2. The arrangement as set forth in claim 1 wherein said vibration dampening member is formed from a material composed of rubber and barium ferrite powder.

* * * * *